US009631898B2

(12) United States Patent
Bhatnagar et al.

(10) Patent No.: US 9,631,898 B2
(45) **Date of Patent: *Apr. 25, 2017**

(54) PROTECTIVE HELMETS

(75) Inventors: Ashok Bhatnagar, Richmond, VA (US); Lori L. Wagner, Richmond, VA (US); Brian D. Arvidson, Chester, VA (US); Bradley L. Grunden, Richmond, VA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 2837 days.

This patent is subject to a terminal disclaimer.

(21) Appl. No.: 11/706,719

(22) Filed: Feb. 15, 2007

(65) Prior Publication Data

US 2013/0212763 A1 Aug. 22, 2013

(51) Int. Cl.

| | |
|---|---|
| ***F41H 1/08*** | (2006.01) |
| ***A42B 3/06*** | (2006.01) |
| ***A42C 2/00*** | (2006.01) |

(52) U.S. Cl.

CPC ..... *F41H 1/08* (2013.01); *A42B 3/063* (2013.01); *A42C 2/00* (2013.01)

(58) Field of Classification Search

CPC .. B32B 5/26; B32B 5/024; B32B 5/04; B32B 5/08; B32B 5/10; B32B 2260/04; B32B 2260/046; F41H 1/04; F41H 1/08; F41H 5/0471; F41H 5/0478; C08J 5/04; C08J 5/046; C08J 5/047; C07D 209/54; C07D 209/96; C07D 401/04; C07D 471/04; C07D 487/04; C07D 491/10; C07D 491/107; C07D 498/04; C07D 513/04; A42B 3/06; A42B 3/02; A42B 3/03; A42B 3/063; A42C 2/00

USPC ..... 2/1, 455, 2.5, 410, 4, 5, 6, 421, 295.1, 2/295.4, 297.1, 299.7, 300.4; 264/258; 428/911, 912, 920; 442/134, 135, 218, 442/220, 245, 246, 247, 248, 268, 278

See application file for complete search history.

(56) References Cited

U.S. PATENT DOCUMENTS

| | | | | |
|---|---|---|---|---|
| 3,671,542 | A | 6/1972 | Kwolek | 524/157 |
| 4,137,394 | A | 1/1979 | Meihuizen et al. | 528/100 |
| 4,199,388 | A | 4/1980 | Tracy et al. | 156/166 |
| 4,356,138 | A | 10/1982 | Kavesh et al. | 264/164 |
| 4,403,012 | A | 9/1983 | Harpell et al. | |
| 4,413,110 | A | 11/1983 | Kavesh et al. | 526/348.1 |
| 4,457,985 | A | 7/1984 | Harpell et al. | 428/224 |
| 4,737,402 | A | 4/1988 | Harpell et al. | |
| 4,778,638 | A | 10/1988 | White | 264/152 |
| 4,868,040 | A | 9/1989 | Hallal et al. | |
| 4,908,877 | A | 3/1990 | White | 2/412 |
| 4,953,234 | A | 9/1990 | Li et al. | 2/412 |
| 5,018,220 | A | 5/1991 | Lane | |
| 5,112,667 | A | 5/1992 | Li et al. | 428/113 |
| 5,395,671 | A | 3/1995 | Coppage, Jr. | |
| 5,552,208 | A | 9/1996 | Lin et al. | |
| 5,660,913 | A | 8/1997 | Coppage, Jr. | |
| 5,702,657 | A | 12/1997 | Yoshida et al. | 264/112 |
| 6,012,178 | A | 1/2000 | Schuster | |
| 6,103,646 | A * | 8/2000 | Chiou | 442/244 |
| 6,642,159 | B1 | 11/2003 | Bhatnagar et al. | 442/134 |
| 7,642,206 | B1 | 1/2010 | Bhatnagar et al. | |
| 7,648,607 | B2 | 1/2010 | Morin | |
| 7,700,503 | B2 | 4/2010 | Thomas, Jr. | |
| 8,853,105 | B2 * | 10/2014 | Bhatnagar et al. | 442/135 |
| 2006/0048284 | A1 | 3/2006 | Kapah | |
| 2015/0020283 | A1 * | 1/2015 | Bhatnagar et al. | 2/2.5 |

FOREIGN PATENT DOCUMENTS

| | | |
|---|---|---|
| DE | 4207294 | 9/1992 |
| EP | 0645415 | 3/1995 |
| GB | 2253589 | 9/1992 |
| GB | 2276935 | 10/1994 |
| JP | 03069603 | 3/1991 |
| JP | 09-174765 | 7/1997 |
| JP | 2003269898 | 9/2003 |
| KR | 10-0504096 | 7/2005 |
| KR | 20-0392560 | 8/2005 |
| TW | 566096 | 12/2003 |
| WO | 0029468 | 5/2000 |

OTHER PUBLICATIONS

"Purchase Description—Helmet Advanced Combat (ACH)," Oct. 30, 2007.

EPO decision revoking corresponding European Patent EP2111128, no date.

* cited by examiner

*Primary Examiner* — Arti Singh-Pandey

(74) *Attorney, Agent, or Firm* — Roberts & Roberts, LLP; Richard S. Roberts, Jr.

(57) ABSTRACT

A helmet shell formed from two types of high tenacity fibers in multiple layers of fibrous materials. The fibrous materials are in the form of layers of fibrous networks in a resin matrix. There are a plurality of each type of fibrous layers. Preferably the outer set of fibrous layers is formed from aramid fibers and the inner set of fibrous layers is formed from high tenacity polyolefin fibers. There may also be employed a third type of fibrous material as an additional set of fibers and used as the outer layers of the helmet shell. The third type of fibrous layers is formed from glass fibers that are also in a resin matrix. The helmet is lightweight, has excellent ballistic resistant properties and is useful for both military and non-military applications.

32 Claims, No Drawings

PROTECTIVE HELMETS

BACKGROUND OF THE INVENTION

Field of the Invention

This invention relates to protective helmets which are useful for military, law enforcement and other applications.

Description of the Related Art

Protective helmets are well known. Such helmets have been used for military and non-military applications. Examples of the latter include law enforcement uses, sporting uses and other types of safety helmets. Protective helmets used for military and law enforcement uses, in particular, need to be ballistic resistant.

The currently most popular military helmets are formed from aramid fibers, typically in the form of several layers of aramid fibers together with a resin material, such as a phenolic resin. Helmets formed of aramid fibers are disclosed, for example, in U.S. Pat. Nos. 4,199,388, 4,778,638 and 4,908,877. Although such helmets in general perform satisfactorily, they are fairly heavy.

It would be desirable to provide a protective helmet which has a reduced weight and also has increased ballistic resistance against threat projectiles.

SUMMARY OF THE INVENTION

In accordance with this invention, there is provided a molded helmet comprising a shell, the shell comprising from the outside to the inside:

a first plurality of fibrous layers, the fibrous layers comprising a network of high tenacity fibers in a first resin matrix, the high tenacity fibers comprising polyolefin fibers or aramid fibers; and a second plurality of fibrous layers adhered to the first plurality of fibrous layers, said second plurality of fibrous layers comprising a network of high tenacity fibers in a second resin matrix, the high tenacity fibers comprising polyolefin fibers or aramid fibers, with the proviso that when the fibers of the first plurality of fibrous layers comprise polyolefin fibers then the fibers of the second plurality of fibrous to layers comprise aramid fibers, and when the fibers of said first plurality of fibrous layers comprise aramid fibers then the fibers of the second plurality of fibrous layers comprise polyolefin fibers.

Also in accordance with this invention, there is provided a molded helmet comprising a shell, the shell comprising from the outside to the inside:

a first plurality of fibrous layers, the fibrous layers comprising glass fibers in a first resin matrix;

a second plurality of fibrous layers adhered to the first plurality of fibrous layers, the second plurality of fibrous layers comprising a network of high tenacity fibers in a second resin matrix, the high tenacity fibers comprising polyolefin fibers or aramid fibers; and a third plurality of fibrous layers adhered to the second plurality of fibrous layers, the third plurality of fibrous layers comprising a network of high tenacity fibers in a third resin matrix, the high tenacity fibers comprising polyolefin fibers or aramid fibers, with the proviso that when the fibers of the second plurality of fibrous layers comprise polyolefin fibers then the fibers of the third plurality of fibrous layers comprise aramid fibers, and when the fibers of the second plurality of fibrous layers comprise aramid fibers then the fibers of the third plurality of fibrous layers comprise polyolefin fibers.

Further in accordance with this invention, there is provided a method for forming a shell of a helmet comprising the steps of:

supplying a first plurality of fibrous layers to a mold, the fibrous layers comprising a network of high tenacity fibers in a first resin matrix, the high tenacity fibers comprising polyolefin fibers or aramid fibers;

supplying a second plurality of fibrous layers to the mold, the second plurality of fibrous layers comprising a network of high tenacity fibers in a second resin to matrix, the high tenacity fibers comprising polyolefin fibers or aramid fibers, with the proviso that when the fibers of the first plurality of fibrous layers comprise polyolefin fibers then the fibers of the second plurality of fibrous layers comprise aramid fibers, and when the fibers of the first plurality of fibrous layers comprise aramid fibers then the fibers of the second plurality of fibrous layers comprise polyolefin fibers; and applying heat and pressure to the first plurality of fibrous layers and the second plurality of fibrous layers, whereby the first plurality of fibrous layers is adhered to the second plurality of fibrous layers to thereby form an integral helmet shell.

In still further accordance with this invention, there is provided a method for forming a shell of a helmet comprising the steps of:

supplying a first plurality of fibrous layers to a mold, the fibrous layers comprising glass fibers in a first resin matrix;

supplying a second plurality of fibrous layers to the mold, the second plurality of fibrous layers comprising a network of high tenacity fibers in a second resin matrix, the high tenacity fibers comprising polyolefin fibers or aramid fibers;

supplying a third plurality of fibrous layers to the mold, the third plurality of fibrous layers comprising a network of high tenacity fibers in a third resin matrix, the high tenacity fibers comprising polyolefin fibers or aramid fibers, with the proviso that when the fibers of the second plurality of fibrous layers comprise polyolefin fibers then the fibers of the third plurality of fibrous layers comprise aramid fibers, and when the fibers of the second plurality of fibrous layers comprise aramid fibers then the fibers of the third plurality of fibrous layers comprise polyolefin fibers; and applying heat and pressure to the first plurality of fibrous layers, the second plurality of fibrous layers and the third plurality of fibrous layers, the first plurality of fibrous layers is adhered to the second plurality of fibrous layers and the second plurality of fibrous layers is adhered to the third plurality of fibrous layers to thereby form an integral helmet shell.

It has been discovered that by using two separate sets of fibrous networks of high strength fibers, a lighter weight helmet can be produced. Furthermore, the cost of the helmet can be significantly reduced by employing a third set of fibrous networks of glass fibers. The helmets of this invention have excellent ballistic resistance and are capable of deforming projectiles and catching the fragmented or deformed projectiles. The helmets provide the necessary protective systems for ballistic protection, but also can be used in non-ballistic applications.

Preferably, with a structure formed from two pluralities of layers, the outer layer is formed from aramid fibers and the inner layer is formed from high tenacity polyolefin fibers (more preferably, high tenacity polyethylene fibers). With a three component helmet material, the outer layer is formed from a plurality of layers of glass fibers, the middle layer is preferably formed from a plurality of layers of aramid fibers, and the inner layers is preferably formed from a plurality of high tenacity polyolefin fibers (more preferably, high tenacity polyethylene fibers).

DETAILED DESCRIPTION OF THE INVENTION

The protective helmets of this invention include a plurality of layers of a high strength aramid network of fibers and a plurality of layers of a high strength polyolefin network of fibers. As mentioned above, they may also include a plurality of layers of glass fiber networks.

For the purposes of the present invention, a fiber is an elongate body the length dimension of which is much greater that the transverse dimensions of width and thickness. Accordingly, the term fiber includes monofilament, multifilament, ribbon, strip, staple and other forms of chopped, cut or discontinuous fiber and the like having regular or irregular cross-section. The term "fiber" includes a plurality of any of the foregoing or a combination thereof. A yarn is a continuous strand comprised of many fibers or filaments.

As used herein, the term "high tenacity fibers" means fibers which have tenacities equal to or greater than about 7 g/d. Preferably, these fibers have initial tensile moduli of at least about 150 g/d and energies-to-break of at least about 8 J/g as measured by ASTM D2256. As used herein, the terms "initial tensile modulus", "tensile modulus" and "modulus" mean the modulus of elasticity as measured by ASTM 2256 for a yarn and by ASTM D638 for an elastomer or matrix material.

Preferably, the high tenacity fibers have tenacities equal to or greater than about 10 g/d, more preferably equal to or greater than about 15 g/d, even more preferably equal to or greater than about 20 g/d, and most preferably equal to or greater than about 25 g/d.

The cross-sections of fibers useful in this invention may vary widely. They may be circular, flat or oblong in cross-section. They also may be of irregular or regular multi-lobal cross-section having one or more regular or irregular lobes projecting from the linear or longitudinal axis of the filament. It is particularly preferred that the fibers be of substantially circular, flat or oblong cross-section, most preferably that the fibers be of substantially circular cross-section.

The yarns of the high tenacity fibers used herein may be of any suitable denier, such as, for example, about 50 to about 5000 denier, more preferably from about 200 to about 5000 denier, still more preferably from about 650 to about 3000 denier, and most preferably from about 800 to about 1500 denier.

The fiber networks of this invention preferably are in the form of woven, knitted or non-woven fabrics. Preferably, at least about 50% by weight of the fibers in the layers of the plurality of layers of high tenacity fibers are the high tenacity fibers. More preferably at least about 75% by weight of the fibers in the layers of the plurality of layers of high tenacity fibers are the high tenacity fibers. Most preferably all or substantially all of the fibers in the layers of the plurality of layers of high tenacity fibers are the high tenacity fibers.

In accordance with the invention, the helmet shell is formed from layers of different ballistic materials. Preferably, there is one group of layers of fibers formed from one type of high tenacity fiber and there is a second group of layers of fibers formed from a second type of high tenacity fiber. These fibers are either aramid fibers or polyolefin fibers. The polyolefin fibers are preferably high tenacity polyethylene fibers and/or high tenacity polypropylene fibers. Most preferably, the polyolefin fibers are high tenacity polyethylene fibers, also known as extended chain polyethylene fibers or highly oriented high molecular weight polyethylene fibers. The aramid and polyolefin fibers useful herein are known and possess excellent ballistic resistant properties.

U.S. Pat. No. 4,457,985 generally discusses high molecular weight polyethylene fibers and polypropylene fibers, and the disclosure of this patent is hereby incorporated by reference to the extent that it is not inconsistent herewith. In the case of polyethylene fibers, suitable fibers are those of weight average molecular weight of at least about 150,000, preferably at least about one million and more preferably between about two million and about five million. Such high molecular weight polyethylene fibers may be spun in solution (see U.S. Pat. No. 4,137,394 and U.S. Pat. No. 4,356,138), or a filament spun from a solution to form a gel structure (see U.S. Pat. No. 4,413,110, German Off. No. 3,004, 699 and GB Patent No. 2051667), or the polyethylene fibers may be produced by a rolling and drawing process (see U.S. Pat. No. 5,702,657). As used herein, the term polyethylene means a predominantly linear polyethylene material that may contain minor amounts of chain branching or comonomers not exceeding about 5 modifying units per 100 main chain carbon atoms, and that may also contain admixed therewith not more than about 50 weight percent of one or more polymeric additives such as alkene-l-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, colorants and the like which are commonly incorporated.

High tenacity polyethylene fibers are commercially available and are sold under the trademark SPECTRA® by Honeywell International Inc. of Morristown, N.J., U.S.A. Polyethylene fibers from other sources may also be used.

Depending upon the formation technique, the draw ratio and temperatures, and other conditions, a variety of properties can be imparted to these fibers. The tenacity of the polyethylene fibers is at least about 7 g/d, preferably at least about 15 g/d, more preferably at least about 20 g/d, still more preferably at least about 25 g/d and most preferably at least about 30 g/d. Similarly, the initial tensile modulus of the fibers, as measured by an Instron tensile testing machine, is preferably at least about 300 g/d, more preferably at least about 500 g/d, still more preferably at least about 1,000 g/d and most preferably at least about 1,200 g/d. These highest values for initial tensile modulus and tenacity are generally obtainable only by employing solution grown or gel spinning processes. Many of the filaments have melting points higher than the melting point of the polymer from which they were formed. Thus, for example, high molecular weight polyethylene of about 150,000, about one million and about two million molecular weight generally have melting points in the bulk of 138° C. The highly oriented polyethylene filaments made of these materials have melting points of from about 7° C. to about 13° C. higher. Thus, a slight increase in melting point reflects the crystalline perfection and higher crystalline orientation of the filaments as compared to the bulk polymer.

Similarly, highly oriented high molecular weight polypropylene fibers of weight average molecular weight at least about 200,000, preferably at least about one million and more preferably at least about two million may be used. Such extended chain polypropylene may be formed into reasonably well oriented filaments by the techniques prescribed in the various references referred to above, and especially by the technique of U.S. Pat. No. 4,413,110. Since polypropylene is a much less crystalline material than polyethylene and contains pendant methyl groups, tenacity values achievable with polypropylene are generally substantially lower than the corresponding values for polyethylene. Accordingly, a suitable tenacity is preferably at least about 8 g/d, more preferably at least about 11 g/d. The initial tensile modulus for polypropylene is preferably at least about 160 g/d, more preferably at least about 200 g/d. The melting point of the polypropylene is generally raised several degrees by the orientation process, such that the polypropylene filament preferably has a main melting point of at least 168° C., more preferably at least 170° C. The particularly preferred ranges for the above described parameters can advantageously provide improved performance in the final article. Employing fibers having a weight average molecular weight of at least about 200,000 coupled with the preferred ranges for the above-described parameters (modulus and tenacity) can provide advantageously improved performance in the final article.

In the case of aramid fibers, suitable fibers formed from aromatic polyamides are described in U.S. Pat. No. 3,671,542, which is incorporated herein by reference to the extent not inconsistent herewith. Preferred aramid fibers will have a tenacity of at least about 20 g/d, an initial tensile modulus of at least about 400 g/d and an energy-to-break at least about 8 J/g, and particularly preferred aramid fibers will have a tenacity of at least about 20 g/d and an energy-to-break of at least about 20 J/g. Most preferred aramid fibers will have a tenacity of at least about 20 g/d, a modulus of at least about 900 g/d and an energy-to-break of at least about 30 J/g. For example, poly(p-phenylene terephthalamide) filaments which have moderately high moduli and tenacity values are particularly useful in forming ballistic resistant composites. Examples are Kevlar® 29 which has 500 g/d and 22 g/d and Kevlar® 49 which has 1000 g/d and 22 g/d as values of initial tensile modulus and tenacity, respectively. Other examples are Kevlar® 129 and KM2 which are available in 400, 640 and 840 deniers from du Pont, and Twaron® T2000 from Teijin which has a denier of 1000. Aramid fibers from other manufacturers can also be used in this invention. Copolymers of poly(p-phenylene terephthalamide) may also be used, such as co-poly(p-phenylene terephthalamide 3,4' oxydiphenylene terephthalamide). Also useful in the practice of this invention are poly(m-phenylene isophthalamide) fibers sold by du Pont under the trade name Nomex®. Aramid fibers from a variety of suppliers may be used in the present invention.

The high strength fibers are in a network which is preferably in the form of a woven, knitted or non-woven fabric (such as plies of unidirectionally oriented fibers, or fibers which are felted in a random orientation). Woven fabrics of any weave pattern may be employed, such as plain weave, basket weave, twill, satin, three dimensional woven fabrics, and any of their several variations. Plain weave fabrics are preferred and more preferred are plain weave fabrics having an equal warp and weft count.

The networks of fibers in each group of layers of fibers are preferably in the same fabric format (e.g., woven, knitted or non-woven). Alternatively, there may be a mixture of the type of fabrics in the layers of each group of layers of fibers. In one preferred embodiment, the layers of fibers in both groups of fibers all are in the form of a woven fabric.

In one embodiment, the fabric preferably has between about 15 and about 55 ends per inch (about 5.9 to about 21.6 ends per cm) in both the warp and fill directions, and more preferably between about 17 and about 45 ends per inch (about 6.7 to about 17.7 ends per cm). The yarns preferably have a denier of from about 375 to about 1300. The result is a woven fabric weighing preferably between about 5 and about 19 ounces per square yard (about 169.5 to about 644.1 g/m$^2$), and more preferably between about 5 and about 11 ounces per square yard (about 169.5 to about 373.0 g/m$^2$). Examples of such fabrics are those designated as SPECTRA® fabric styles 902, 903, 904, 952, 955 and 960. Other examples included fabrics formed from basket weaves, such as SPECTRA® fabric style 912. Examples of aramid fabric are those designated as Kevlar® fabric styles 704, 705, 706, 708, 710, 713, 720, 745, and 755 and Twaron® fabric styles 5704, 5716, and 5931. The foregoing fabrics are available, for example, from Hexcel of Anderson, S.C., USA. As those skilled in the art will appreciate, the fabric constructions described here are exemplary only and not intended to limit the invention thereto.

As mentioned above, the fabric may be in the form of a knitted fabric. Knit structures are constructions composed of intermeshing loops, with the four major types being tricot, raschel, net and oriented structures. Due to the nature of the loop structure, knits of the first three categories are not as suitable as they do not take full advantage of the strength of a fiber. Oriented knitted structures, however, use straight inlaid yarns held in place by fine denier knitted stitches. The yarns are absolutely straight without the crimp effect found in woven fabrics due to the interlacing effect on the yarns. These laid in yarns can be oriented in a monoaxial, biaxial or multiaxial direction depending on the engineered requirements. It is preferred that the specific knit equipment used in laying in the load bearing yarns is such that the yarns are not pierced through.

Alternatively, the high strength fabric of the group of layers of the network of fibers may be in the form of a non-woven fabric, such as plies of unidirectionally oriented fibers, or fibers which are felted in a random orientation. Where unidirectionally oriented fibers are employed, preferably they are used in a cross-ply arrangement in which one layer of fibers extend in one direction and a second layer of fibers which extend in a direction 90° from the first fibers. Where the individual plies are unidirectionally oriented fibers, the successive plies are preferably rotated relative to one another, for example at angles of 0°/90°, 0°/90/0°/90 or 0°/45°/90°/45°/0° or at other angles. Where the networks of fibers are in the form of a felt, they may be needle punched felts. A felt is a non-woven network of randomly oriented fibers, preferably at least one of which is a discontinuous fiber, preferably a staple fiber having a length ranging from about 0.25 inch (0.64 cm) to about 10 inches (25 cm). These felts may be formed by several techniques known in the art, such as by carding or fluid laying, melt blowing and spin laying. The network of fibers is consolidated mechanically such as by needle punching, stitch-bonding, hydro-entanglement, air entanglement, spun bond, spun lace or the like, chemically such as with an adhesive, or thermally with a fiber to point bond or a blended fiber with a lower melting point. The preferred consolidation method is needle punching alone or followed by one of the other methods. The preferred felt is a needle punched felt.

The fibrous layers are in a resin matrix. The resin matrix for the fiber plies may be formed from a wide variety of elastomeric and other materials having desired characteristics. In one embodiment, elastomeric materials used in such matrix possess initial tensile modulus (modulus of elasticity) equal to or less than about 6,000 psi (41.4 MPa) as measured by ASTM D638. More preferably, the elastomer has initial tensile modulus equal to or less than about 2,400 psi (16.5 MPa). Most preferably, the elastomeric material has initial tensile modulus equal to or less than about 1,200 psi (8.23 MPa). These resinous materials are typically thermoplastic in nature but thermosetting materials are also useful.

Preferably, the resin matrix may be selected to have a high tensile modulus when cured, such as at least about $1\times10^6$ psi (6895 MPa) as measured by ASTM D638. Examples of such materials are disclosed, for example, in U.S. Pat. No. 6,642,159, the disclosure of which is expressly incorporated herein by reference to the extent not inconsistent herewith.

The proportion of the resin matrix material to fiber in the composite layers may vary widely depending upon the end use. The resin matrix material preferably forms about 1 to about 98 percent by weight, more preferably from about 5 to about 95 percent by weight, still more preferably from about 5 to about 40 percent by weight, and most preferably from about 10 to about 25 percent by weight, of the total weight of the fibers and resin matrix. The above percentages are based on the consolidated fabrics.

A wide variety of materials may be utilized as the resin matrix, including thermoplastic and thermosetting resins, with the latter being preferred. For example, any of the following materials may be employed: polybutadiene, polyisoprene, natural rubber, ethylene-propylene copolymers, ethylene-propylene-diene terpolymers, polysulfide polymers, thermoplastic polyurethanes, polyurethane elastomers, chlorosulfonated polyethylene, polychloroprene, plasticized polyvinylchloride using dioctyl phthalate or other plasticizers well known in the art, butadiene acrylonitrile elastomers, poly (isobutylene-co-isoprene), polyacrylates, polyesters, polyethers, fluoroelastomers, silicone elastomers, thermoplastic elastomers, and copolymers of ethylene. Examples of thermosetting resins include those which are soluble in carbon-carbon saturated solvents such as methyl ethyl ketone, acetone, ethanol, methanol, isopropyl alcohol, cyclohexane, ethyl acetone, and combinations thereof. Among the thermosetting resins are vinyl esters, styrene-butadiene block copolymers, diallyl phthalate, phenolic resins such as phenol formaldehyde, polyvinyl butyral, epoxy resins, polyester resins, polyurethane resins, and mixtures thereof, and the like. Included are those resins that are disclosed in the aforementioned U.S. Pat. No. 6,642,159. Preferred thermosetting resins include epoxy resins, phenolic resins, vinyl ester resins, urethane resins and polyester resins, and mixtures thereof. Preferred thermosetting resins for polyethylene fiber fabrics include at least one vinyl ester, diallyl phthalate, and optionally a catalyst for curing the vinyl ester resin.

One preferred group of elastomeric materials are block copolymers of conjugated dienes and vinyl aromatic copolymers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type R-$(BA)_x$ (x=3–150); wherein A is a block from a polyvinyl aromatic monomer and B is a block from a conjugated diene elastomer. A preferred resin matrix is an isoprene-styrene-isoprene block copolymer, such as Kraton® D1107 isoprene-styrene-isoprene block copolymer available from Kraton Polymer LLC. Another resin matrix useful herein is a thermoplastic polyurethane, such as a copolymer mix of polyurethane resins dispersed in water.

The resin material may be compounded with fillers such as carbon black, silica, etc and may be extended with oils and vulcanized by sulfur, peroxide, metal oxide or radiation cure systems using methods well known to rubber technologists. Blends of different resins may also be used.

Preferably, the resin matrix in each of the plurality of fibrous layers are either the same as or are compatible with the resin matrix in the other plurality or pluralities of fibrous layers. By "compatible" is meant that the resin chemistry is such that each prepreg resin can be processed under the same molding pressure, temperature and molding duration. This ensures that the helmet shell can be molded in one cycle, regardless of whether there are two or more pluralities of fibrous layers of different fibers.

As mentioned above, in certain aspects of the invention a plurality of fibrous layers of glass fibers are employed, preferably as the outer layer of the helmet shell. These layers also are formed as layers of fibers which are in a resin matrix. The resins useful for the glass fiber layers are the same as mentioned above with respect to the high tenacity fiber layers, and may be present in the fiber layers in same amounts as indicated above for the other layers. Various types of glass fibers may be used herein, including Types E and S fibers. The glass fiber layers may also be present in various fabric forms, such as the woven, knitted and non-woven (both unidirectional and randomly felted) fabric types mentioned above with respect to the high tenacity fiber layers. Examples of woven fiberglass fabrics are those designated as styles 1528, 3731, 3733, 7500, 7532, 7533, 7580, 7624, 7628 and 7645, which are available from Hexcel.

By using fiberglass prepregs, the cost of the helmets can be significantly decreased since the fiberglass costs only a fraction compared to the cost of the aramid and the polyethylene fabrics. The glass fiber layers are the most stiff and are highly abrasive. As such, they are desirably placed as the outer layers of the helmet. The aramid fiber layers have good ballistic resistance and decent back face deformation, and are suitable in particular for use as the central section of the three section composite helmet. The polyethylene fabric composite is relatively flexible and the least abrasive when molded and has the lowest weight and highest ballistic resistance against certain projectiles. The polyethylene fabric is particularly suitable for use as the inner of the three sections of the helmet. Alternatively, in a three section helmet the polyethylene layers may be the center section and the aramid layers may be employed as the inner section of the composite helmet.

Where the helmet is formed from only two sections of high tenacity fibrous layers, preferably the outer section is formed from the aramid layers and the inner section is formed from the polyethylene layers, but this could be reversed if desired.

Preferably, each of the plurality of fibrous layers is coated or impregnated with the resin matrix prior to molding, so as to form prepreg fabrics. In general, the fibrous layers of the invention are preferably formed by constructing a fiber network initially (e.g., starting with a woven fabric layer) and then coating the network with the matrix composition. As used herein, the term "coating" is used in a broad sense to describe a fiber network wherein the individual fibers either have a continuous layer of the matrix composition surrounding the fibers or a discontinuous layer of the matrix composition on the surfaced of the fibers. In the former case, it can be said that the fibers are fully embedded in the matrix composition. The terms coating and impregnating are interchangeably used herein. Although it is possible to apply the resin matrix to resin-free fibrous layers while in the mold, this is less desirable since the uniformity of the resin coating may be difficult to control.

The matrix resin composition may be applied in any suitable manner, such as a solution, dispersion or emulsion, onto the fibrous layers. The matrix-coated fiber to network is then dried. The solution, dispersion or emulsion of the matrix resin may be sprayed onto the filaments. Alternatively, the fibrous layer structure may be coated with the aqueous solution, dispersion or emulsion by dipping or by means of a roll coater or the like. After coating, the coated fibrous layer may then be passed through an oven for drying in which the coated fiber network layer or layers are subjected to sufficient heat to evaporate the water or other liquid in the matrix composition. The coated fibrous network may then be placed on a carrier web, which can be a paper or a film substrate, or the fabrics may initially be placed on a carrier web before coating with the matrix resin. The substrate and the resin matrix containing fabric layer or layers can then be wound up into a continuous roll in a known manner.

The fiber networks can be constructed via a variety of methods. In the case of unidirectionally aligned fiber networks, yarn bundles of the high tenacity filaments may be supplied from a creel and led through guides and one or more spreader bars into a collimating comb prior to coating with the matrix material. The collimating comb aligns the filaments coplanarly and in a substantially unidirectional fashion.

Following coating of the fabric layers with the resin matrix, the layers are preferably consolidated in a known manner to form a prepreg. By "consolidating" is meant that the matrix material and the fiber network layer are combined into a single unitary layer. Consolidation can occur via drying, cooling, heating, pressure or a combination thereof.

The number of layers in each section of the plurality of fibrous layers may vary widely, depending on the type of helmet desired, the desired performance and the desired weight. For example, the number of layers in each section of the plurality of fibrous layers may range from about 2 to about 40 layers, more preferably from about 2 to about 25 layers, and most preferably from about 2 to about 15 layers. The number of layers in each section of the plurality of fibrous layers may be different or may be the same. The layers may be of any suitable thickness. For example, each layer of a section of the plurality of fibrous layers may have a thickness of from about 1 mil to about 40 mils (25 to 1016 μm), more preferably from about 3 to about 30 mils (76 to 762 μm), and most preferably from about 5 to about 20 mils (127 to 508 μm). The thickness of each layer of each plurality of fibrous networks may be the same or different.

Likewise, the weight of each layer in each section of the plurality of fibrous layers may vary widely but is usually chosen so that the overall weight of the helmet is within an acceptable range for the comfort and protection of the wearer. For example, the weight of each layer in each section of the plurality of fibrous layers may range from about 5 to about 200 grams, more preferably from about 10 to about 100 grams, and most preferably from about 20 to about 75 grams. Again, the weight of each layer of each plurality of fibrous networks may be the same or different. In one example for a shell with two sections of the plurality of fibrous layers, the total weight of the first plurality of fibrous layers ranges from about 200 (preferably about 400) to about 600 grams, and the total weight of the second plurality of fibrous layers correspondingly ranges from about 600 to about 200 (preferably about 400) grams.

The weight ratio of the layers may vary as desired. For a helmet shell formed from only the two sections of high tenacity fabrics, the aramid-containing layers may be present in an amount of from about 20 to about 80 weight percent based on the total weight of the helmet shell, more preferably from about 35 to about 65 weight percent, and most preferably from about 45 to about 55 weight percent. Correspondingly, the polyolefin-containing layers may be present in an amount of from about 80 to about 20 weight percent, more preferably from about 65 to about 35 weight percent, and most preferably from about 55 to about 45 weight percent, based on the total weight of the helmet shell.

For a helmet shell formed from three sections of the fabrics used herein, the glass fiber-containing layers may be present in an amount, based on the total weight of the helmet shell, of from about 5 to about 65 weight percent, more preferably from about 10 to about 50 weight percent, and most preferably from about 20 to about 40 weight percent; the aramid-containing layers may be present in an amount of from about 5 to about 65 weight percent, more preferably from about 10 to about 50 weight percent, and most preferably from about 20 to about 40 weight percent; and the polyolefin-containing layers may be present in an amount of from about 5 to about 65 weight percent, more preferably from about 10 to about 50 weight percent, and most preferably from about 20 to about 40 weight percent. In one example of a helmet shell formed from such three sections of fabrics, the total weight of each of the first, second and third plurality of fibrous layers has a weight in the range of from about 250 to about 400 grams.

One type of helmet that has been widely employed in military applications is known by the acronym PASGT (Personnel Armor System for Ground Troops). Desirably, such medium helmets have a weight in the range of from about 750 to about 1500 grams, and more preferably from about 800 to about 1100 grams.

To form the helmet shells of this invention, prepregs of the two or more types of fibrous networks are applied to a mold. Where only two sections or prepregs are employed, preferably the desired number of the individual layers of the aramid fibers in the resin matrix are placed into a suitable mold in a position to form the outer section of the helmet shell. The mold may be of any desired type, such as a matched die mold. Next the desired number of the individual layers of the high tenacity polyethylene fibers are placed in the mold and positioned such that they form the inner section of the helmet shell. Certainly the order may be reversed depending on which fiber layers are desired to be the outer layers of the helmet. Desirably, the resin is chosen so that it is non-tacky when placed into the mold. This permits the individual layers to slide over each other in order to completely fill the mold and form the desired helmet shape. No adhesive is required to be used between the individual layers or groups of layers of the high tenacity fibers, since the resin or resins of the individual layers provide the needed bonding between the layers. However, a separate adhesive layer or layers may be used if desired.

Care should be taken to completely and uniformly fill the mold and place all of the layers in the proper orientation. This ensures uniform performance throughout the helmet shell. If the combined volume of the hybrid materials is more than the helmet mold can handle, the mold will not close and hence the helmet will not be molded. If the combined volume of the hybrid materials is less than the volume of the mold, although the mold will close the material will not be molded due to lack of molding pressure.

Once the mold is properly loaded with the desired number and type of fibrous layers, the helmet shell can be molded under the desired molding conditions. These conditions can be similar to those employed in molding separate layers of aramid fabrics and separate layers of polyethylene fabrics. For example, the molding temperature may range from about 65 to about 250° C., more preferably from about 90 to about 330° C., and most preferably from about 120 to about 320° C. The clamp molding pressure may range, for example, from about 10 to about 500 tons (10.2 to 508 metric tons), more preferably from about 50 to about 350 tons (50.8 to 356 metric tons), and most preferably from about 100 to about 200 tons (102 to 203 metric tons). The molding times may range from about 5 to about 60 minutes, more preferably from about 10 to about 35 minutes, and most preferably from about 15 to about 25 minutes.

Under the desired conditions of molding, the resin or resins present in the fibrous networks is cured in the case of thermosetting resins. This results in strong bonding of the individual layers and groups of layers into the desired helmet shape as an integral, monolithic molding. It is believed that the thermosetting resins of each set of fabrics are bonded at their interfaces by cross-linking of the resins. For thermoplastic resins the helmet is cooled down below the softening temperature of the resin and then pull out from the mold. Under heat and pressure, the thermoplastic resins flow between the fabric layers, also resulting in an integral, monolithic molding. During cooling the molding pressure is maintained. The molded product is thereafter taken from the mold and the part is trimmed, if necessary.

Although it is preferred to have a first stack of one type of high strength fibrous networks and a second stack of high strength fibrous networks formed from a different fiber, it is possible to include layers of each fiber type in one or both stacks of fibrous layers. These may alternate in a repeating or non-repeating pattern. However, it is preferred that each stack is formed from a single type of high tenacity fibrous material.

In the case of three prepreg different types, a helmet is preferably formed by first introducing the glass fiber fabric layers into the mold, then introducing the aramid fabric layers (if they are to be the middle section of the construction) and finally introducing the polyolefin fabric layers (if they are to be the inner section of the helmet shell. Again, the order of introduction of the three different types of prepregs can vary depending on which prepregs are desired to be in the outer layers, the middle layers and the inner layers of the helmet shell.

The fabrics used in the composite structure are relatively thin yet very strong. The preferred thickness of the individual fabric layers are from about 1 to about 36 mils (25 to 911 μm), more preferably from about 5 to about 28 mils (127 to 711 μm), and most preferably from about 10 to about 23 mils (254 to 584 μm).

The following non-limiting examples are presented to provide a more complete understanding of the invention. The specific techniques, conditions, materials, proportions and reported data set forth to illustrate the principles of the invention are exemplary and should not be construed as limiting the scope of the invention. All percents are by weight, unless otherwise stated.

EXAMPLES

Example 1

A helmet shell was formed from layers of high tenacity aramid fibers and layers of high tenacity polyethylene fibers. The aramid fibers were in the form of layers of Kevlar® woven fabric, style 705 which is a plain weave 31×31 ends per inch (12 by 12 ends per cm) construction. The fabric layer has a weight of 6.8 oz./sq. yd. (231 g/sq. m) and a thickness of 12 mil (305 μm). Each fabric layer was coated with a vinyl ester resin (Derakane 411-45 resin from Ashland Chemical) as follows. A resin solution is prepared by diluting with an industrial solvent such as acetone and adding a curing agent. The fabric is mounted on a frame to maintain uniform tension and the fabric is dipped into the solution so as to be fully covered by the resin mix. The coated fabric was dried under heat below 75° C. for sufficient time to achieve less than 1% volatile content. The prepreg fabrics are then wrapped on a roll with a release film or paper to avoid direct contact with each other. After drying, the resin content on the fabric layer was 15.2 weight percent.

The polyethylene fibers were in the form of layers of Spectra® fabric style 903 which is a plain weave 21×21 ends per inch (8.3×8.3 ends per cm) construction. The fabric layer had a weight of 7 oz./sq. yd. (237 g/sq. m) and a thickness of 20 mil (508 μm). The polyethylene fabric was coated with the same vinyl resin as used with the aramid fabric by the same technique. The resin content on the fabric after drying was 15.3%.

A helmet shell was molded from 17 layers of the aramid fabric and 13 layers of the polyethylene fabric. The shell shape was a PASGT mold, with a helmet mold thickness of 0.310 inch (7.8 mm). The fabric layers were in the form of a pinwheel pattern with three 7 inch (17.8 cm) crown wheels in each helmet. Crown plies are smaller diameter pinwheels used to compensate for the thickness in the crown area. Areas other than the crown have overlaps of the fabric due to the helmet shape. The aramid layers were individually placed in the mold in a direction such that the aramid layers were at the outside of the helmet shell. The polyethylene layers were placed on top of the aramid layers so as to be on the inside of the helmet shell. A helmet was molded at 190 ton (193 metric ton) clamp pressure at 250 ° F. (121° C.) for 15 minutes of heating, followed by a cool down to 220 ° F. (104° C.) for 15 minutes. The resulting helmet had a trim shell weight of 1035 grams.

The helmet was tested for ballistic performance under MIL-STD-662F standard using a 17 grain fragment simulating projectile (FSP) conforming to MIL-P-46593A standard. The results are shown in Table 1, below. The V50 velocity is shown for each helmet construction. The V50 velocity is that velocity for which the projectile has a 50% probability of penetration.

Example 2

A helmet was molded as in Example 1 with the following differences. Three sets of fabrics were used. The outer layers were fiberglass woven fabric style 7628 from Hexcel, which is a plain weave 17×12 ends per inch (6.7×4.7 ends per cm) construction. The fabric layer had a weight of 6.0 oz./sq. yd and a thickness of 6.8 mils (172 μm). Each fabric layer was coated with the same vinyl ester resin as was used with the aramid fabrics and the polyethylene fabrics, using the same techniques. After drying, the resin content on the fabric layer was 10.1 weight percent.

A helmet shell was molded from 10 layers of the glass fabric as the outer layers, 12 layers of the aramid fabric as the middle layers, and 12 layers of the polyethylene fabric as the inner layers. The same medium PASGT shell shape match-die mold was used. A helmet was molded under the same conditions as Example 1. The helmet had a trim weight of 1112 grams.

The helmet was tested for ballistic performance under MIL-STD-662F standard using a 17 grain FSP conforming to MIL-P-46593A standard. The results are shown in Table 1, below.

Example 3 (Comparative)

A helmet shell was formed solely from layers of the polyethylene fabric employed in Example 1. A total of 25 layers of the polyethylene fabric were introduced into the mold and a helmet was molded under the same conditions as in Example 1. The trim shell weight was 849 grams.

The helmet was tested for ballistic performance under MIL-STD-662F standard using a 17 grain FSP conforming to MIL-P-46593A standard. The results are shown in Table 1, below.

Example 4 (Comparative)

A helmet shell was formed solely from layers of the aramid fabric employed in Example 1. A total of 33 layers of the aramid fabric were introduced into the mold and a helmet was molded under the same conditions as in Example 1. The trim shell weight was 1103 grams.

The helmet was tested for ballistic performance under MIL-STD-662F standard using a 17 grain FSP conforming to MIL-P-46593A standard. The results are shown in Table 1, below.

TABLE 1

| Example | Layers of Polyethylene Fabric | Layers of Aramid Fabric | Layers of Fiber Glass Fabric | Trim Shell Weight, grams | 17 grain FSP V50, fps (mps) |
|---|---|---|---|---|---|
| 1 | 13 | 17 | 0 | 1035 | 2168 (661.2) |
| 2 | 12 | 12 | 10 | 1112 | 2144 (653.9) |
| 3* | 25 | 0 | 0 | 849 | 2010 (613.0) |
| 4* | 0 | 33 | 0 | 1103 | 2095 (639.0) |

*= comparative example

It can be seen that the use of two ballistic materials in a single molded ballistic helmet shell provides higher ballistic resistance against 17 grain FSP projectiles than the comparative helmet shells formed from only high tenacity polyethylene fibers or from only aramid fibers. In addition, the use of three ballistic materials in a single molded ballistic helmet shell provides the highest ballistic resistance against 17 grain FSP projectiles. The cost of the latter helmets is significantly reduced when compared to the single material expensive helmets and is achieved without sacrifying the salient ballistic resistance of the single material helmets.

In addition, the process of molding a two or three ballistic material helmet shell without the requirement for changing match die molds provides additional choices to select a variety of materials for ballistic helmet designs. Furthermore, the same mold that is used to produce a single fiber type of helmet shell can be used to produce the multi-material helmet shells of this invention.

Example 5

A helmet shell was formed in the same manner as in Example 1 using the same number of aramid fabric layers and the same number of polyethylene fabric layers, with the aramid fabric layers being on the outside.

A helmet shell was molded under the same conditions as in Example 1. The trim shell weight was 1039 grams.

The helmet was tested for ballistic performance using as a projectile a 9 mm full metal jacket (FMJ) 124 grain bullet. The results are shown in Table 2, below.

Example 6

A helmet shell was formed in the same manner as in Example 2 using the same number of fiberglass fabric layers, aramid fabric layers and polyethylene fabric layers. The helmet shell was formed under the same conditions as in Example 1, with the glass fiber fabric layers being on the outside, the aramid fabric layers being in the middle and the polyethylene fabric layers being on the inside. The trim shell weight was 1122 grams.

The helmet was tested for ballistic performance using as a projectile a 9 mm full metal jacket (FMJ) 124 grain bullet. The results are shown in Table 2, below.

Example 7 (Comparative)

A helmet shell was formed solely from layers of the polyethylene fabric employed in Example 1. A total of 25 layers of the polyethylene fabric were introduced into the mold and a helmet was molded under the same conditions as in Example 1. The trim shell weight was 853 grams.

The helmet was tested for ballistic performance using as a projectile a 9 mm full metal jacket (FMJ) 124 grain bullet. The results are shown in Table 2, below.

Example 8 (Comparative)

A helmet shell was formed solely from layers of the aramid fabric employed in Example 1. A total of 33 layers of the aramid fabric were introduced into the mold and a helmet was molded under the same conditions as in Example 1. The trim shell weight was 1098 grams.

The helmet was tested for ballistic performance using as a projectile a 9 mm full metal jacket (FMJ) 124 grain bullet. The results are shown in Table 2, below.

TABLE 2

| Example | Layers of PE Fabric | Layers of Aramid Fabric | Layers of Fiber Glass Fabric | Trim Shell Weight, grams | 9 mm FMJ V50, fps (mps) | 9 mm FMJ V50 Deformation, mm |
|---|---|---|---|---|---|---|
| 5 | 13 | 17 | 0 | 1039 | 1785 (544.4) | 51 |
| 6 | 12 | 12 | 10 | 1112 | 1698 (517.8) | 32 |
| 7* | 25 | 0 | 0 | 853 | 1810 (552.1) | 45 |
| 8* | 0 | 33 | 0 | 1098 | 1758 (536.2) | 29 |

*= comparative example

It can be seen that the use of two ballistic materials in a single molded ballistic helmet shell provide ballistic resistance against 9 mm FMJ bullets that compares well with the ballistic resistance of helmet shells formed only from high tenacity polyethylene fibers or from only aramid fibers, and also have acceptable back face deformation. In addition, the use of three ballistic materials in a single molded ballistic helmet shell provides comparative ballistic resistance against 9 mm FMJ bullets when compared to helmet shells formed from only high tenacity polyethylene fibers or from only aramid fibers. Furthermore, the three ballistic material helmet shell had very low back face deformation and thus would have further reduced back face trauma. The cost of the three ballistic material helmet shell is significantly reduced when compared to the single material expensive helmets and is achieved without sacrifying the desirable ballistic resistance when compared to the single material helmet shells.

The helmets of this invention have excellent ballistic resistance as well as impact resistance and structural rigidity. They may be produced in lighter weights than the conventional helmets. The helmets are useful in military and non-military applications, such as law enforcement helmets, sporting helmets and other types of safety helmets.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A molded helmet having structural rigidity, said molded helmet comprising a shell, said shell comprising from the outside to the inside:

a first plurality of fibrous layers, said fibrous layers comprising a network of high tenacity fibers in a first resin matrix, said high tenacity fibers comprising polyolefin fibers or aramid fibers; wherein said network of high tenacity fibers of said first plurality of fibrous layers is in the form of a woven fabric; and a second plurality of fibrous layers adhered to said first plurality of fibrous layers, said second plurality of fibrous layers comprising a network of high tenacity fibers in a second resin matrix, said high tenacity fibers comprising polyolefin fibers or aramid fibers, wherein said fibers of said first plurality of fibrous layers comprise aramid fibers and said fibers of said second plurality of fibrous layers comprise polyolefin fibers, and wherein said first plurality of fibrous layers comprises from 35 to 65 weight percent of said shell, and said second plurality of fibrous layers correspondingly comprises from 65 to 35 weight percent of said shell.

2. The helmet of claim 1 wherein the fibers of said first plurality of fibrous layers consist of aramid fibers that are fully embedded in the first resin matrix and the fibers of said second plurality of fibrous layers consist of polyolefin fibers that are fully embedded in the second resin matrix.

3. The helmet of claim 2 wherein said polyolefin fibers comprise polyethylene fibers, and wherein each of said first resin matrix and said second resin matrix comprises a copolymer mix of polyurethane resins.

4. The helmet of claim 1 wherein said first plurality of fibrous layers and said second plurality of fibrous layers each weigh from 169.5 $g/m^2$ to 644.1 $g/m^2$.

5. The helmet of claim 1 wherein said first plurality of fibrous layers and said second plurality of fibrous layers each weigh from 169.5 $g/m^2$ to 373.0 $g/m^2$.

6. The helmet of claim 1 wherein said network of high tenacity fibers of said second plurality of fibrous layers is in the form of a unidirectionally oriented non-woven fabric or a felted fabric.

7. The helmet of claim 1 wherein each of said first and second resins consists of one or more thermosetting resins, wherein each resin matrix has a tensile modulus when cured of at least about $1\times10^6$ psi (6895 MPa) as measured by ASTM D638.

8. The helmet of claim 7 wherein said network of high tenacity fibers of said second plurality of fibrous layers is in the form of a woven fabric.

9. The helmet of claim 8 wherein wherein the fibers of said first plurality of fibrous layers are fully embedded in the first resin matrix and wherein the fibers of said second plurality of fibrous layers are fully embedded in the second resin matrix.

10. The helmet of claim 1 wherein said first and second resins each comprise a vinyl ester resin.

11. The helmet of claim 1 wherein said first plurality of fibrous layers comprises from about 45 to about 55 weight percent of said shell, and said second plurality of fibrous layers correspondingly comprises from about 55 to about 45 weight percent of said shell.

12. The helmet of claim 1 wherein the weight of said first plurality of fibrous layers is approximately the same as the weight of said second plurality of fibrous layers.

13. The helmet of claim 1 wherein the fibers of said first plurality of fibrous layers consist of polyethylene fibers and the fibers of said second plurality of fibrous layers consist of aramid fibers, and both of said networks of said first and second plurality of fibrous layers are in the form of woven fabrics.

14. The helmet of claim 1 wherein said first and second resins each comprise vinyl ester resins, and wherein the fibers of said first plurality of fibrous layers are fully embedded in the first resin matrix and wherein the fibers of said second plurality of fibrous layers are fully embedded in the second resin matrix.

15. The helmet of claim 1 wherein the weight of said first plurality of fibrous layers is in the range of from about 200 to about 600 grams, and the weight of said second plurality of fibrous layers correspondingly is in the range of from about 600 to about 200 grams.

16. The helmet of claim 1 wherein said first resin comprises from about 10 to about 25 weight percent of the total weight of said first plurality of fibrous layers and said second resin comprises from about 10 to about 25 weight percent of the total weight of said second plurality of fibrous layers.

17. The helmet of claim 1 further comprising a plurality of fibrous layers comprising glass fibers in a third resin matrix, said plurality of glass fiber layers being positioned on the outside of said shell.

18. A molded helmet having structural rigidity, said molded helmet comprising a shell, said shell comprising from the outside to the inside:

a first plurality of fibrous layers, said fibrous layers comprising glass fibers in a first resin matrix; wherein said first plurality of fibrous layers is in the form of a woven fabric;

a second plurality of fibrous layers adhered to said first plurality of fibrous layers, said second plurality of fibrous layers comprising a network of high tenacity fibers in a second resin matrix, said high tenacity fibers comprising polyolefin fibers or aramid fibers; and a third plurality of fibrous layers adhered to said second plurality of fibrous layers, said third plurality of fibrous layers comprising a network of high tenacity fibers in a third resin matrix, said high tenacity fibers comprising polyolefin fibers or aramid fibers, with the proviso that when said fibers of said second plurality of fibrous layers comprise polyolefin fibers then said fibers of said third plurality of fibrous layers comprise aramid fibers, and when said fibers of said second plurality of fibrous layers comprise aramid fibers then said fibers of said third plurality of fibrous layers comprise polyolefin fibers.

19. The helmet of claim 18 wherein the fibers of said first plurality of fibrous layers consist of glass fibers, the fibers of said second plurality of fibrous layers consist of aramid fibers and the fibers of said third plurality of fibrous layers consist of polyethylene fibers.

20. The helmet of claim 18 wherein said first, second and third resins each comprise vinyl ester resins, and wherein the fibers of said first plurality of fibrous layers are fully embedded in the first resin matrix, wherein the fibers of said second plurality of fibrous layers are fully embedded in the second resin matrix, and wherein the fibers of said third plurality of fibrous layers are fully embedded in the third resin matrix.

21. The helmet of claim 18 wherein said first plurality of fibrous layers comprises from about 20 to about 40 weight percent of said shell, said second plurality of fibrous layers comprises from about 20 to about 40 weight percent of said shell, and said third plurality of fibrous layers comprises from about 20 to about 40 weight percent of said shell.

22. The helmet of claim 18 wherein said first plurality of fibrous layers, said second plurality of fibrous layers and said third plurality of fibrous layers each have approximately the same weight.

23. The helmet of claim 18 wherein said networks of high strength fibers of said second and third plurality of fibrous layers are in the form of a woven fabric, a knitted fabric, a unidirectionally oriented non-woven fabric or a felted fabric.

24. The helmet of claim 23 wherein said networks of high strength fibers of said second plurality of fibrous layers and said third plurality of fibrous layers are in the form of woven fabrics.

25. The helmet of claim 24 wherein each said first, second and third resins consists of one or more thermosetting resins, wherein each resin matrix has a tensile modulus when cured of at least about $1\times10^6$ psi (6895 MPa) as measured by ASTM D638.

26. The helmet of claim 18 wherein each said first, second and third resins consists of one or more thermosetting resins, wherein each resin matrix has a tensile modulus when cured of at least about $1\times10^6$ psi (6895 MPa) as measured by ASTM D638.

27. The helmet of claim 18 wherein said first, second and third resins each comprise a vinyl ester resin.

28. The helmet of claim 18 wherein the fibers of said first plurality of fibrous layers are fully embedded in the first resin matrix, wherein the fibers of said second plurality of fibrous layers are fully embedded in the second resin matrix, and wherein the fibers of said third plurality of fibrous layers are fully embedded in the third resin matrix.

29. A method for forming a shell of a helmet having structural rigidity, said method comprising the steps of:

supplying a first plurality of fibrous layers to a mold, said fibrous layers comprising a network of high tenacity fibers in a first resin matrix, said high tenacity fibers comprising polyolefin fibers or aramid fibers; wherein said network of high tenacity fibers of said first plurality of fibrous layers is in the form of a woven fabric;

supplying a second plurality of fibrous layers to said mold, said second plurality of fibrous layers comprising a network of high tenacity fibers in a second resin matrix, said high tenacity fibers comprising polyolefin fibers or aramid fibers, wherein said fibers of said first plurality of fibrous layers comprise aramid fibers and said fibers of said second plurality of fibrous layers comprise polyolefin fibers; and wherein said first plurality of fibrous layers comprises from 35 to 65 weight percent of said shell, and said second plurality of fibrous layers correspondingly comprises from 65 to 35 weight percent of said shell, and applying heat and pressure to said first plurality of fibrous layers and said second plurality of fibrous layers, whereby said first plurality of fibrous layers is adhered to said second plurality of fibrous layers to thereby form an integral helmet shell.

30. The method of claim 29 wherein said first plurality of fibrous layers comprises aramid fibers and said second plurality of fibrous layers comprises high tenacity polyethylene fibers; said first and second resins are chemically the same and consist of one or more thermosetting resins, wherein each resin matrix has a tensile modulus when cured of at least about $1\times10^6$ psi (6895 MPa) as measured by ASTM D638; each fibrous layer of said first and said second plurality of layers comprises a woven fabric, and said first plurality of fibrous layers comprises from about 2 to about 40 layers and said second plurality of fibrous layers comprises from about 2 to about 40 layers.

31. A method for forming a shell of a helmet having structural rigidity, said method comprising the steps of:

supplying a first plurality of fibrous layers to a mold, said fibrous layers comprising glass fibers in a first resin matrix;

supplying a second plurality of fibrous layers to said mold, said second plurality of fibrous layers comprising a network of high tenacity fibers in a second resin matrix, said high tenacity fibers comprising polyolefin fibers or aramid fibers;

supplying a third plurality of fibrous layers to said mold, said third plurality of fibrous layers comprising a network of high tenacity fibers in a third resin matrix, said high tenacity fibers comprising polyolefin fibers or aramid fibers, with the proviso that when said fibers of said second plurality of fibrous layers comprise polyolefin fibers then said fibers of said third plurality of fibrous layers comprise aramid fibers, and when said fibers of said second plurality of fibrous layers comprise aramid fibers then said fibers of said third plurality of fibrous layers comprise polyolefin fibers; and applying heat and pressure to said first plurality of fibrous layers, said second plurality of fibrous layers and said third plurality of fibrous layers, whereby said first plurality of fibrous layers is adhered to said second plurality of fibrous layers and said second plurality of fibrous layers is adhered to said third plurality of fibrous layers to thereby form an integral helmet shell.

32. The method of claim 31 wherein said second plurality of fibrous layers comprises aramid fibers and said third plurality of fibrous layers comprises high tenacity polyethylene fibers; said first, second and third resins are chemically the same and consist of one or more thermosetting resins, wherein each resin matrix has a tensile modulus when cured of at least about $1\times10^6$ psi (6895 MPa) as measured by ASTM D638; each fibrous layer of said first, said second and said third plurality of layers comprises a woven fabric, and said first plurality of fibrous layers comprises from about 2 to about 40 layers, said second plurality of fibrous layers comprises from about 2 to about 40 layers and said third plurality of fibrous layers comprise from about 2 to about 40 layers.

* * * * *